US009204745B2

(12) United States Patent
Bateman

(10) Patent No.: US 9,204,745 B2
(45) Date of Patent: Dec. 8, 2015

(54) CUP HOLDER

(71) Applicant: Alison Bateman, Surrey (GB)

(72) Inventor: Alison Bateman, Surrey (GB)

( * ) Notice: Subject to any disclaimer, the term of this patent is extended or adjusted under 35 U.S.C. 154(b) by 0 days.

(21) Appl. No.: 14/352,011

(22) PCT Filed: Oct. 18, 2012

(86) PCT No.: PCT/GB2012/000797

§ 371 (c)(1),
(2) Date: Apr. 15, 2014

(87) PCT Pub. No.: WO2013/057467

PCT Pub. Date: Apr. 25, 2013

(65) Prior Publication Data

US 2014/0306002 A1 Oct. 16, 2014

(30) Foreign Application Priority Data

Oct. 21, 2011 (GB) ..... 1118287.0

(51) Int. Cl.

| | |
|---|---|
| ***A47G 19/22*** | (2006.01) |
| ***B65D 23/02*** | (2006.01) |
| ***B65D 25/28*** | (2006.01) |
| ***A47G 23/02*** | (2006.01) |
| ***B65D 71/40*** | (2006.01) |

(52) U.S. Cl.

CPC ..... *A47G 19/2205* (2013.01); *A47G 23/0216* (2013.01); *B65D 25/28* (2013.01); *B65D 25/2867* (2013.01); *B65D 25/2876* (2013.01); *B65D 71/406* (2013.01)

(58) Field of Classification Search

CPC ..... B65D 25/28; B65D 25/325; B65D 25/32; B65D 25/2876; B65D 25/2873; B65D 25/2867; B65D 71/406; A47G 19/2205; A47G 23/0216; A47G 23/0208; A47G 23/02

USPC ..... 220/769, 760, 759, 737, 754, 738; 229/402

See application file for complete search history.

(56) References Cited

U.S. PATENT DOCUMENTS

| | | | | |
|---|---|---|---|---|
| 1,539,201 | A * | 5/1925 | Ottow | 294/31.2 |
| 3,482,867 | A | 12/1969 | Allen | |
| 3,709,544 | A | 1/1973 | Oltmanns | |
| 3,709,545 | A | 1/1973 | Oltmanns | |

(Continued)

FOREIGN PATENT DOCUMENTS

| | | |
|---|---|---|
| GB | 2083436 A | 3/1982 |
| GB | 2407252 A | 4/2005 |

(Continued)

*Primary Examiner* — Robert J Hicks

(74) *Attorney, Agent, or Firm* — Cowan, Liebowitz & Latman, P.C.; Mark Montague

(57) ABSTRACT

A cup holder comprises a collar (2) and a handle (4) comprising a continuous loop of flexible sheet material in which two opposed holes (6) are formed and which, in use, extends around and engages the outer surface of a cup. The handle (4) comprises an elongate strip of flexible sheet material, integral with each end of which are two lugs (10), which extend laterally in opposite directions. Each lug (10) has a distal edge (23), a proximal edge (22), and an end edge (24). The proximal edge (22) of each lug defines an angle with the adjacent edge of the handle of less than 90 degrees. The two ends of the handle (4) are pivotally received in respective holes (6) with the two lugs on one side of the collar (2) and the adjacent portion of the handle being on the other side of the collar.

5 Claims, 4 Drawing Sheets

(56) References Cited

U.S. PATENT DOCUMENTS

| | | | | |
|---|---|---|---|---|
| 4,244,498 | A * | 1/1981 | Copp | 294/162 |
| 5,137,209 | A * | 8/1992 | Roberts et al. | 229/117.25 |
| 5,203,481 | A * | 4/1993 | Dobbins et al. | 224/148.4 |
| 6,257,440 | B1 * | 7/2001 | Perkins et al. | 220/764 |
| 6,269,949 | B1 | 8/2001 | Gottlieb | |
| 7,857,197 | B2 * | 12/2010 | Rosendall | 229/117.19 |
| 2008/0093242 | A1 * | 4/2008 | Rosendall | 206/423 |
| 2012/0160859 | A1 * | 6/2012 | Bateman | 220/737 |

FOREIGN PATENT DOCUMENTS

| | | | |
|---|---|---|---|
| GB | 2471872 | A | 1/2011 |
| GB | 2472591 | A | 2/2011 |
| WO | 2011007119 | A1 | 1/2011 |

* cited by examiner

CUP HOLDER

CROSS REFERENCE TO RELATED APPLICATIONS

This is a U.S. national phase of application No. PCT/GB2012/000797, filed on Oct. 18, 2012. Priority under 35 U.S.C. §119(a) and 35 U.S.C. §365(b) is claimed from British Patent Application No. 118287.0, filed on Oct. 21, 2011, the disclosure of which is also incorporated herein by reference.

FIELD OF THE INVENTION

The present invention relates to beverage cups and, in particular, to handles for beverage cups and to beverage cups including a handle. The invention is particularly concerned with beverage cups of the type which are of upwardly divergent frusto-conical shape and these are typically made of waxed paper or card and are commonly used in Cafés and the like for the sale of beverages, particularly hot beverages, such as tea, coffee or soup, for consumption on or off the premises.

BACKGROUND OF THE INVENTION

Such cups are very advantageous because they are cheap and effective and may readily be formed into nested stacks and thus require relatively little storage space. They are also biodegradable, in contrast to cups made of plastic material. However, they are not very easy to carry due to the fact that they are flexible and structurally weak and spillages therefore frequently occur. This problem is exacerbated when the beverage to be served is hot because the thermal insulation properties of such cups are relatively poor. Purchasers therefore frequently burn their fingers when carrying such cups filed with a hot beverage and this is not only uncomfortable but also increases the problem of spillages occurring.

In order to obviate these problems, it is known to use a holder or tray of folded cardboard material, which defines a number of recesses for accommodating cups. This largely obviates the problem of burning one's fingers when the cups are filled with a hot beverage but the trays have to be manually folded from flat cardboards blanks and this is quite time-consuming. Furthermore, the tray blanks have to be stored and many retail outlets simply do not have the storage space available for such relatively bulky articles. Finally, the trays are generally disposed of after being used only once and this means that they add not inconsiderably to the overhead expenses of the retail outlet in question and also represent an additional unacceptable environmental burden in that they must all be subsequently disposed of in a land fill or alternatively recycled.

Many of the above problems are solved by the cup holder disclosed in WO2011/007119. This cup holder includes a collar and a handle. The collar is a continuous loop of flexible material in which two opposed holes are formed and which extends around and engages the outer surface of a cup. The handle consists of an elongate strip of flexible sheet material, integral with each end of which are two divergent elongate lugs. The maximum distance between the outer edges of the lugs is greater than the maximum dimension of the holes in the direction of the length of the collar and the width of each lug is less than the said maximum dimension. When the cup holder is assembled, one lug at each end of the handle is folded over on top of the other and the two lugs are then threaded through a respective one of the holes in the collar. The folded lug is then unfolded and the end of the handle is then pivotally attached to the collar with the two lugs on one side of the collar and the adjacent portion of the handle on the other side.

Whilst very effective in many applications it is found that the known cup holder does have some disadvantages and, in particular, that the handle may suddenly become detached from the collar, with the result that the cup falls to the floor. Quite apart from potential damage to the floor or floor covering, if the cup contains scalding liquid this could clearly be associated with injury to the user and is therefore highly undesirable. The risk of such failure occurring is increased when the cup and its contents are heavy and it is thought that the pressure exerted by the edges of the holes in the collar on the side edges of the lugs can act to cause the lugs to fold sufficiently to enable them to slip out of the associated hole. This problem could be overcome by making the handle thicker and thus more rigid by using thicker card or board but this makes the initial assembly of the handle more difficult and it also results in the handle becoming heavier and thus more expensive and this is not acceptable for a component that is very cheap and in most cases used only once. The problem referred to above is thought to be even more severe if the handle is made of plastic sheet material, such as polypropylene, and this is thought to be due to the softening of the material that occurs if the contents of the cup are very hot.

OBJECT AND SUMMARY OF THE INVENTION

It is therefore the object of the invention to provide a cup holder which overcomes the problem referred to above but which is no heavier and no more expensive and no more difficult to assemble than the known cup holder referred to above.

According to a first aspect of the present invention, there is provided a cup holder comprising a collar and a handle, the collar comprising a continuous loop of flexible sheet material in which two opposed holes are formed and which, in use, extends around and engages the outer surface of a cup, the handle comprising an elongate strip of flexible sheet material, integral with each end of which are two lugs which extend laterally in opposite directions, each lug having a distal edge, a proximal edge, an end edge and a length which does not exceed the width of the handle at the region with which the lugs are integral, the proximal edge of each lug defining an angle with the adjacent edge of the handle of less than 90°, the width of the handle at the region with which the lugs is integral being no greater than the maximum dimension of the holes in the direction of the length of the collar and the distance between the two end edges being greater than the said maximum dimension, the two ends of the handle being pivotally received in respective holes with the two lugs on one side of the collar and the adjacent portion of the handle being on the other side of the collar. Thus the cup holder in accordance with the invention includes a collar comprising a continuous flexible loop and the diameter of this loop will be arranged to be greater than that of the lower portion of a frusto-conical beverage cup with which it is to be used but less than that of the upper portion of the cup. The cup is simply inserted into the collar from above and the collar then moves up the outer surface of the cup until it can move no further and the collar is then effectively connected to the cup and can support its weight. Two opposed holes are formed in the collar, at positions which, in use, will be diametrically opposed and the cup holder also includes a handle which comprises an elongate strip of flexible sheet material. At each end of the handle are two opposed, laterally extending lugs and the maximum width of these lugs together, that is to say the maximum distance of the outer edges of the lugs, is greater than the maximum dimension of the holes. However, the length of each lug, that is to say the dimension from its outer edge or side surface to the hypothetical line along which the lug is integral with the handle, is not substantially greater than the width of the handle at the region with which the lugs are integral and the width of the handle at that region is no greater than the maximum dimension of the holes. In practice, if the sheet material is rigid card or the like the length of each lug will be equal to or less than the width of the handle so that when it is folded over it will pass readily through the hole in the collar. However, if the sheet material is thin and flexible, e.g. of plastic material, the lugs could be slightly longer than the width of the handle on the basis that when the lugs are folded over the small portion which protrudes beyond the edge of the handle will be bent or deflected when inserting the handle and the lugs through the hole and will thus not prevent insertion. This opens up a very simple assembly method which involves folding both lugs inwardly about the hypothetical line along which they are integral with the handle and then sliding the two lugs and the end of the handle, which the lugs now overlie, through one of the holes in the collar. Once this has been done, the two folded lugs are unfolded and the end of the handle is then retained in a pivotable manner in the hole. When the handle is used to carry a cup, a compressive force will act on the portion of the handle or the lugs within the hole but this force will act in the plane of the handle and is in any event relatively small and will be insufficient to crush the handle, whereby the handle is retained pivotally connected to the collar at two positions. More importantly, the fact that the proximal edges or side surface extend at an acute angle to the adjacent side edge of the handle, rather than an obtuse angle as in the prior document referred to above, means that the force acting on the lugs does not tend to fold them into the position in which disconnection of the handle and collar is liable to occur. A cup containing a hot beverage may therefore simply be carried with the aid of the handle without the risk of burning one's fingers and when it is desired to drink the beverage from the cup the handle is simply pivoted out of the way and the mug may then be used in the conventional manner, without the risk of the cup and the handle becoming inadvertently disconnected. This enhanced security is observed when the sheet material is both card or cardboard or sheet plastic material, e.g. of polypropylene.

The cup holder referred to above is intended for carrying only a single cup but it will be appreciated that a minor modification will permit it to carry more than one cup, that is to say two, three or even four cups. Thus in accordance with a further aspect of the present invention, there is provided a cup holder comprising two or more collars, a handle and a support ring, each collar comprising a continuous loop of flexible sheet material which, in use, extends around and engages the outer surface of a respective cup, each collar being connected to at least one of the other collars, the support ring comprising a continuous ring of flexible sheet material in which two opposed holes are formed, the support ring constituting an elongate strip of flexible sheet material which is constituted in part by portions of the collars or to which portions of the collars are connected, the handle comprising an elongate strip of flexible sheet material, integral with each end of which are two lugs which extend laterally in opposite directions, each lug having a distal edge, a proximal edge, an end edge and a length which does not exceed the width of the handle at the region with which the lugs are integral, the proximal edge of each lug defining an angle with the adjacent edge of the handle of less than 90°, the width of the handle at the region with which the lugs is integral being no greater than the maximum dimension of the holes in the direction of the length of the collar and the distance between the two end edges being greater than the said maximum dimension, the two ends of the handle being pivotably received in respective holes with the two lugs on one side of the support ring and the adjacent portion of the handle on the other side of the support ring.

The cup holder in accordance with this aspect of the present invention is very similar to the cup holder in accordance with the first aspect of the invention but in this case two, three or even four collars are provided, each of which, in use, will engage around and support a respective cup. The cup holder additionally includes a support ring and this is either constituted in part by portions of the collars or the collars are connected to it over a portion of their length. In order to ensure stability, each collar is connected to at least one further collar. If there are two collars, they will be connected together at a position substantially in the centre of the support ring. If there are three collars, it is likely that each collar will be connected to both of the other collars at spaced positions which will be arranged symmetrically with respect to the central axis of the support ring. The method of use and the advantages of this embodiment are essentially the same as those of the first embodiment.

The advantages of the present invention may be realised also in a beverage cup with a permanently connected handle and thus according to a further aspect of the present invention there is a provided a beverage cup including two support members and a handle, the support members being connected to opposed portions of the outer surface of the cup and having respective holes formed in them, the handle comprising an elongate strip of flexible sheet material, integral with each end of which are two lugs which extend laterally in opposite directions, each lug having a distal edge, a proximal edge, an end edge and a length which does not exceed the width of the handle at the region with which the lugs are integral, the proximal edge of each lug defining an angle with the adjacent edge of the handle of less than 90°, the width of the handle at the region with which the lugs is integral being no greater than the maximum dimension of the holes in the direction of the length of the collar and the distance between the two end edges being greater than the said maximum dimension, the two ends of the handle being pivotably received in respective holes with the two lugs sandwiched between the inner surface of a respective support member and the outer surface of the cup and the adjacent portion of the handle being adjacently outer surface of the support member.

Thus in this embodiment the handle is effectively permanently connected to the cup by means of the two support members. The handle will be connected to the cup using substantially the same method as described above and thus the two lugs at each end of the handle will be bent over and the lugs then inserted through a hole in a support member. Once the lugs have been unfolded, the two support members will then be connected to the outer surface of the cup.

It would in fact be possible for the two support members to be integrally connected together and in this event they would constitute part of a support ring extending right around the periphery of the cup. In this event, the cup would differ from a cup supported by a cup holder in accordance with the first aspect of the present invention only in that the support ring is permanently connected rather than removably connected to the outer surface of the cup. It is, however, preferred that the two support members are separate and are connected to the outer surface of the cup, for instance by adhesive or by welding, such that movement of the pairs of lugs in the spaces between the support members and the cup is possible.

In order to ensure that the nesting stackability of the cups is not impaired, it is preferred that the handle is pivotally moveable between a stowed position, in which it has two folds formed in it and is situated substantially in contact with the outer surface of the cup over substantially its entire length, and an operative position, which is rotated through substantially 90° with respect to the stowed position and in which it extends above the cup and may be used to carry it. Thus when the handle is in the stowed position, the outer contour and size of the cup is substantially the same as those of a cup with no handle and the cups can therefore readily be stacked together. However, when a cup is to be used, it is removed from the stack and the handle is then moved from the stowed position to the operative position, thereby permitting the cup to be filled with a hot beverage and carried by means of the handle without any risk of burning the fingers of the user.

The flexible sheet material could be of any desired type but it is preferred that it consists of card or cardboard, preferably of waxed type, or sheet plastic material since these materials are light, cheap and readily available and are also biodegradable or, in the case of sheet plastic material, may be made in biodegradable form.

Whilst the holes, through which the lugs are inserted, may be of any desired shape, it is convenient if they are circular, firstly because such holes are easy and cheap to form and secondly because a circular shape will maximise the strength and tear resistance of the member in which it is formed.

Further features and details of the invention will be apparent from the following description of three specific embodiments, which is given by way of example only with reference to the accompanying drawings, in which:

DETAILED DESCRIPTION OF THE INVENTION

Figure 1:
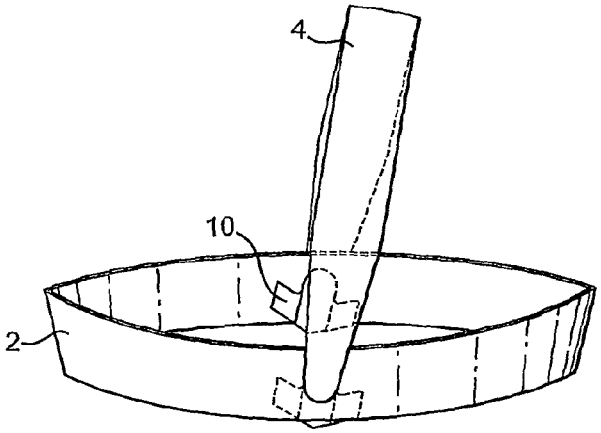
FIG. 1 is a perspective view of a cup holder for a single cup.
Figure 2:
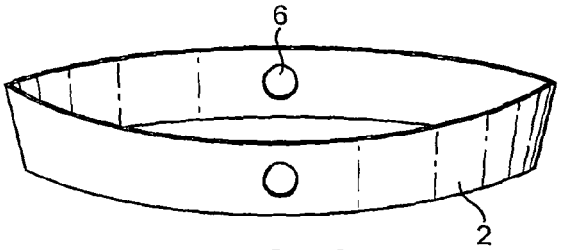
FIG. 2 is a perspective view of the collar in FIG. 1.
Figure 3:
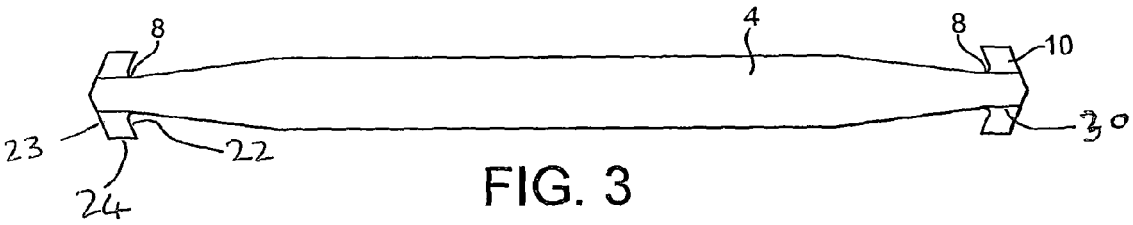
FIG. 3 is a view of the handle of FIG. 1 before connection to the collar.
Figure 4:
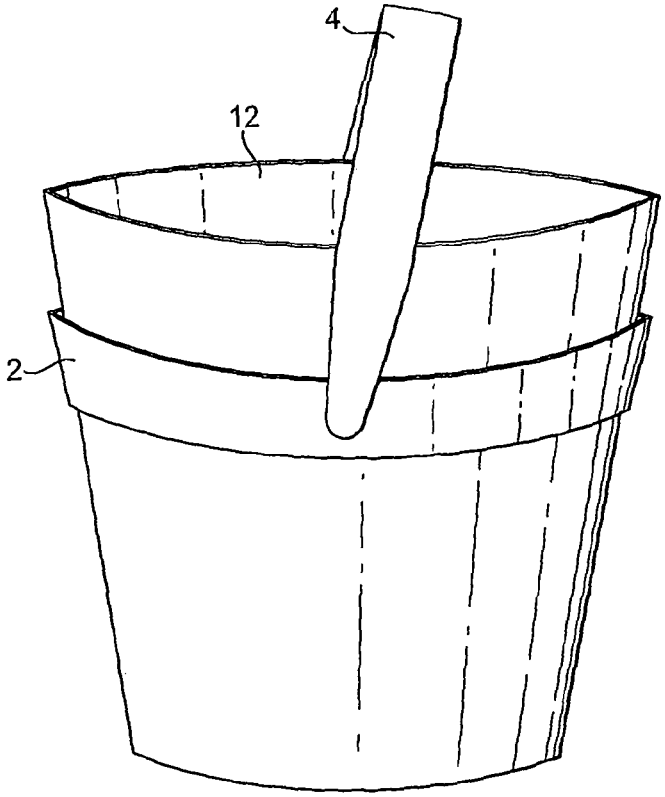
FIG. 4 is a view of the cup holder of FIG. 1 in situ on a cup.

Referring firstly to FIGS. 1 to 4, the cup holder consists of a collar 2 and handle 4. The collar 2 consists of a strip of flexible material, such as card or waxed paper or polypropylene in thin sheet form, the two ends of which are fastened together to form a continuous loop. Formed at positions, which are diametrically opposed to one another in use, are two circular holes 6. Whilst the diameter of the collar may be the same at the top and bottom, it is of course intended to be used with a frusto-conical cup, and it is therefore preferred that the collar is shaped such that its diameter at the top is slightly greater than that at the bottom so as to match the cup with which it is to be used. The handle 4 comprises a elongate strip of the same flexible material. This strip is of constant width over most of its length but towards its ends it tapers to a minimum width at positions 8. Extending in opposite directions from each of these positions are two tabs or lugs 10, which may be considered to be integral with the handle along hypothetical lines 30. Each lug has a proximal side edge or surface 22, a distal side edge 23 and an end edge or surface 24. The distance between the two end edges is greater than the diameter of the holes 6 and the proximal edges define an acute angle, preferably between 60° and 80°, with the adjacent side surface of the handle. The length of each lug, that is to say the maximum distance between the end edge 24 and the hypothetical line 30 is less than the width of the handle, i.e. the distance between two adjacent hypothetical lines 30. The width of the handle at the regions where the lugs are integral with it is no greater than the diameter of the holes 6 and in this case is substantially equal to the diameter of the holes.

In use, the collars and handles will generally be stored separately in a Café or the like, in both cases in a flat condition, which will mean that they occupy very little space. In order to permit the collars to be stored flat, they are each formed with two diametrically opposed folds. When it is desired to use a cup holder, the two lugs 10 at each end of the handle are folded inwardly about the hypothetical lines 30 so as to overlie the handle. The end portions of the handle and the associated lugs are then pushed through a respective one of the holes 6 from the exterior. The folded lugs are then unfolded and the ends of the handle are then pivotally connected to the collar. A cup 12 of waxed paper or card or the like is then filled with a hot beverage and placed in the collar 2 from above. The handle 4 is then grasped and cup holder moved upwardly until it reaches a point at which it can move upwardly no further. The cup may then readily be carried by means of the handle 4. When it is desired to drink a beverage, the handle 4 is pivoted laterally and the cup holder is optionally removed from the cup. The beverage may then be drunk in the usual manner.

Figure 5:
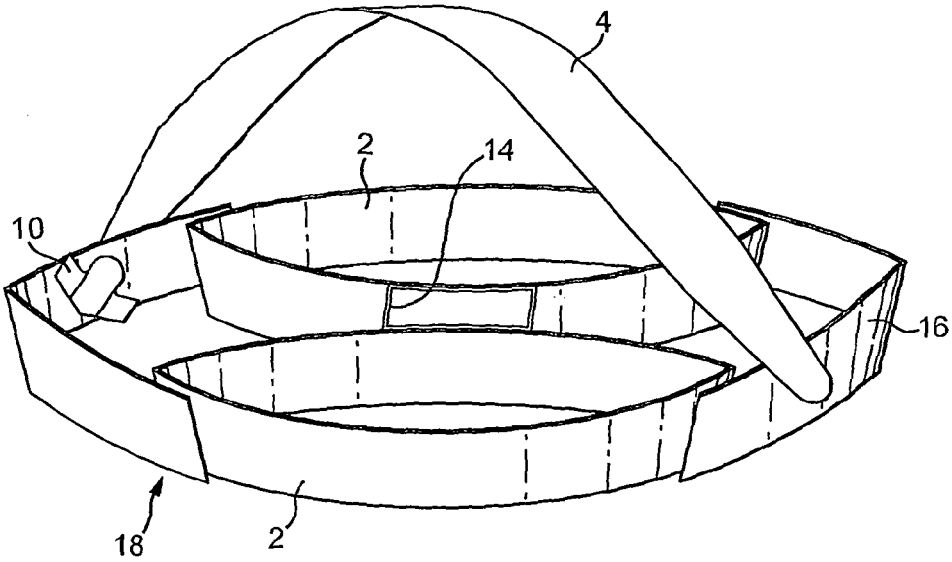
FIG. 5 is a perspective view of a cup holder for two cups.
Figure 6:
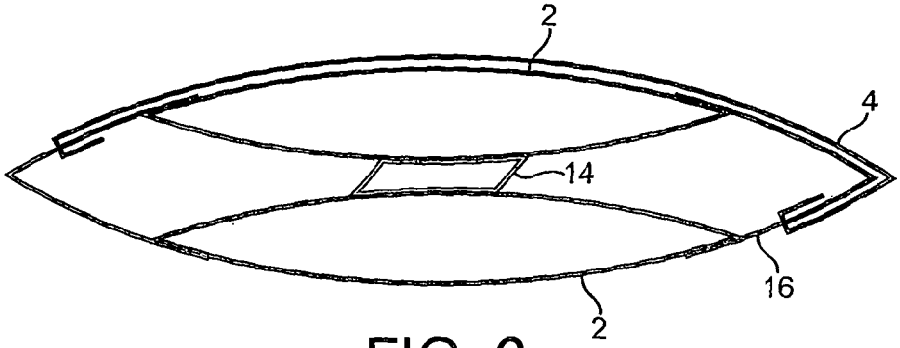
FIG. 6 is a diagrammatic plan view of the cup holder of FIG. 5.

Referring now to FIGS. 5 and 6, the illustrated cup holder is intended for carrying two cups at the same time. In this case, there are two collars 2, which are connected together at one position by a piece of stiff paper or card 14, which is bent into a rectangular shape and whose outer surface is connected to the outer surface of the both collars 2 by means of adhesive. Part of the periphery of each collar 2 together with two further strips 16 of the same material, both of which are connected to both of the collars 2 by adhesive, form an outer support ring 18. Formed in the support ring 18 are two diametrically opposed holes. Pivotally secured in the holes are the two ends of a handle 4, at each of whose ends are two laterally extending lugs 10, as described in relation to FIGS. 1 to 4. The method of assembly, manner of use and advantages of the cup holder illustrated in FIGS. 5 and 6 will be clear from the preceding description of FIGS. 1 to 4.

Figure 9:
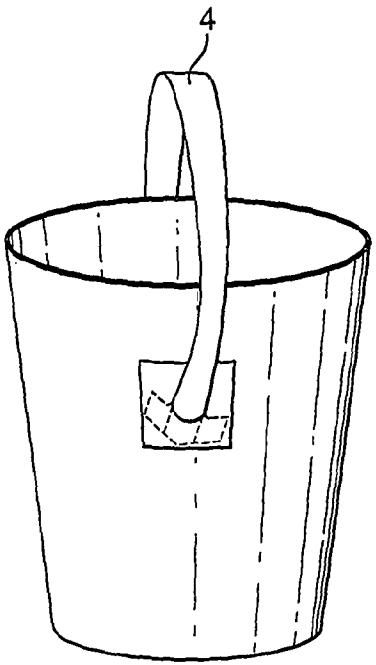
FIG. 9 is a view similar to FIGS. 7 and 8 showing the handle in the operative position.
Figure 8:
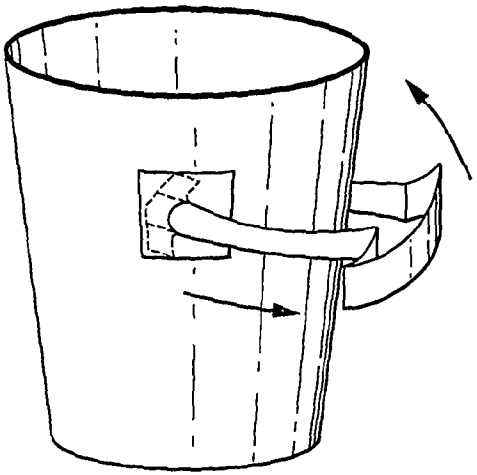
FIG. 8 is a view similar to FIG. 7 showing the handle part way between the stowed and operative positions.
Figure 7:
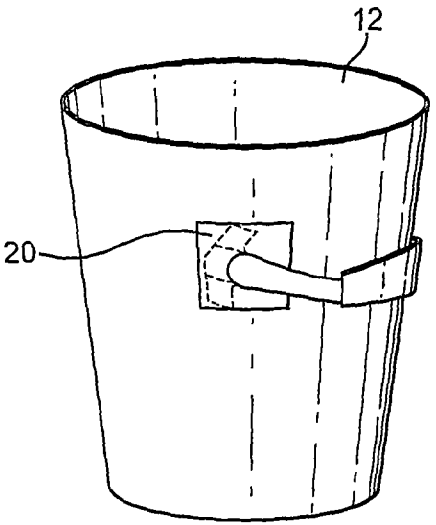
FIG. 7 is a side view of a cup with a handle connected to it in accordance with the invention, in the stowed position.

Turning now to FIGS. 7 to 9, these figures illustrate a beverage cup 12 to which a handle is permanently connected. The handle 4 again has the same construction as in the previous embodiments but in this case its two ends are not connected to a collar but are connected to separate rectangular support members 20, which are again of waxed paper or stiff card. The support members 20 are connected to the outer surface of the cup at diametrically opposed portions by means of adhesive or hot plate welding. The connection is substantially only around the edges of the support members 20, thereby ensuring that the lugs 10 at the ends of the handle 4, which are accommodated between the support members 20 and the cup 12, can rotate freely.

The handle 4 is thus pivotally connected to the cup 12 and is movable between a stowed position and an operative positive. The stowed position is shown in FIG. 7 and, as may be seen in FIG. 8, the handle 4 is provided with two folds which permit the handle to lie snugly against the outer surface of the cup. When it is desired to use the handle, it is initially gripped by the user and pulled horizontally, as indicated by the lower arrow in FIG. 8. The handle is thus moved into the intermediate position shown in FIG. 8. The handle is then rotated upwardly, that is to say generally in the direction of the upper arrow in FIG. 8, until it has reached the operative position shown in FIG. 9. The cup may then be carried by means of the handle without any risk of burning of the fingers of the user.

The invention claimed is:

1. A cup holder comprising a collar and a handle, the collar comprising a continuous loop of flexible sheet material in which two opposed holes are formed and which, in use, extends around and engages an outer surface of a cup, the handle comprising an elongate strip of flexible sheet material, integral with each end of which are two lugs which extend laterally in opposite directions, each lug having a distal edge, a proximal edge, an end edge and a length which does not substantially exceed a width of the handle at the region with which the lugs are integral, the proximal edge of each lug defining an angle with an adjacent edge of the handle of less than 90°, the width of the handle at the region with which the lugs is integral being no greater than the maximum dimension of the holes in the direction of the length of the collar and the distance between the two end edges being greater than the said maximum dimension, the two ends of the handle being pivotally received in respective holes with the two lugs on one side of the collar and the adjacent portion of the handle being on the other side of the collar.

2. A cup holder as claimed in claim 1 in which the flexible sheet material is card or cardboard.

3. A cup holder as claimed in claim 1 in which the flexible sheet material is plastics material.

4. A cup holder as claimed in claim 1 in which the holes are substantially circular.

5. A cup holder as claimed in claim 1 in which a proximal side surface of each lug defines an angle with the adjacent side surface of the handle of between 60° and 80°.

* * * * *